US005727464A

United States Patent [19]

Bahrami et al.

[11] Patent Number: 5,727,464

[45] Date of Patent: Mar. 17, 1998

[54] MODULES WITH LINKING DRIVE SHAFTS

[75] Inventors: Hassan Bahrami; Daniel George Mlejnek, both of Lexington; Harald Portig, Versailles; Richard Andrew Seman, Jr., Lexington, all of Ky.

[73] Assignee: Lexmark International, Inc., Lexington, Ky.

[21] Appl. No.: 705,362

[22] Filed: Aug. 29, 1996

[51] Int. Cl.[6] ..... B41F 5/00

[52] U.S. Cl. ..... 101/216; 101/183; 101/181; 101/152

[58] Field of Search ..... 101/152, 180, 101/181, 182, 183, 216, 217, 218, 219, 220, 479; 271/9

[56] References Cited

U.S. PATENT DOCUMENTS

| | | | |
|---|---|---|---|
| 1,631,236 | 6/1927 | Werner | 180/384 |
| 2,079,668 | 5/1937 | Swift, Jr. | 271/10 |
| 2,115,975 | 5/1938 | Harrold | 101/177 |
| 2,567,127 | 9/1951 | Shoffner | 64/1 |
| 3,087,353 | 4/1963 | Krupp | 74/665 |
| 3,358,595 | 12/1967 | Lindemann | 101/183 |
| 3,452,261 | 6/1969 | Tagliasacchi | 101/183 |
| 3,473,410 | 10/1969 | Kraft | 74/665 |
| 3,511,179 | 5/1970 | Breunig | 101/183 |
| 3,525,305 | 8/1970 | Daniels | 101/181 |
| 3,599,966 | 8/1971 | Vecchio et al. | 271/9 |
| 3,815,380 | 6/1974 | Esmay | 64/4 |
| 3,892,178 | 7/1975 | Staamann | 101/181 |
| 4,214,526 | 7/1980 | Jeschke | 101/216 |
| 4,239,001 | 12/1980 | Kataoka | 101/152 |
| 4,270,367 | 6/1981 | Santore | 64/23 |
| 4,438,697 | 3/1984 | Doliner | 101/216 |
| 4,541,625 | 9/1985 | Yuguchi et al. | 271/42 |
| 5,098,343 | 3/1992 | Tysver et al. | 464/169 |
| 5,392,710 | 2/1995 | Li | 101/219 |

FOREIGN PATENT DOCUMENTS

| | | | |
|---|---|---|---|
| 1761078 | 4/1975 | Germany | 101/183 |
| 1456118 | 11/1976 | United Kingdom | 101/183 |

*Primary Examiner*—Christopher A. Bennett
*Attorney, Agent, or Firm*—John A. Brady

[57] ABSTRACT

Modules, such a paper tray 21, are stacked under a printer (3). Power to drive the paper feed originates from the printer. A housing (9, 27) carries a shaft (17, 35) which is keyed to turn with the housing. The shafts have abutment surfaces (47*a*) which mesh with abutment surfaces on the housing (29*a*, 29*b*). A thrust bearing (51) supporting the housing has a configured bottom to permit limited adjustment by rotation of the housing around the gear (35) at the opposite end of the housing. The top of the modules under the printer extend past their general frame and have a conical guide surface (23) to direct an entering shaft. The bottom of the modules has an opening (19*e*) to receive the extended part from a module on which it is stacked.

21 Claims, 5 Drawing Sheets

18

3
21
8
9
11
13
15
23
53
19
27
7
1
17
39
25
41
5

MODULES WITH LINKING DRIVE SHAFTS

TECHNICAL FIELD

This invention relates to the mechanical transmission of power between separate modules which are brought together.

BACKGROUND OF THE INVENTION

In a printing system a number of optional modules may be stacked together to form a printing station with selected features. Typically, paper or other sheets must be fed from or through all of such modules. When the paper feed motor is in the printer, a mechanical transmission is required to bring power to the other modules. Gear trains are impractical for such extended transmission distances because of a large number of parts and low mechanical efficiency. Also, preferably the modules are brought together with automatic linking between the transmission mechanisms of the options.

U.S. Pat. No. 5,392,710 to Li discusses a printer and a modular feeder brought together with such automatic linking by a clutch and pin mechanism. This invention employs a drive shaft. The following disclose generally similar drive shafts, but not with automatic linking: U.S. Pat. Nos. 2,079,688 to Swift, Jr., 2,115,975 to Harrold; 3,087,353 to Krupp; 3,473,410 to Kraft; and 3,599,966 to Del Vecchio; and 4,541,625 to Yuguchi et al. This invention employs a spring mounted drive shaft to assist in linking. The following disclose spring mounted drive shafts, but not in combined modules: U.S. Pat. Nos. 1,631,236 to Werner; 2,567,127 to Shoffner; 3,815,380 to Esmay; 4,270,367 to Santore and 5,098,343 to Tysver et al.

DISCLOSURE OF THE INVENTION

A first module is the basic printer, which is of form and weight to permit a person or persons to lift it and stack it on the other modules. The other modules are typically paper drawers or a duplexer for printing on two sides. The printer module includes the drive motor, which drives a gear encircling an elongated housing, having a noncircular central hole. A shaft is partially inserted in the hole and has a cross section keyed to the hole in the housing. The shaft is spring mounted downward. The bottom of the shaft has a vertical face to abut the vertical face of a member on which it is stacked to transmit rotary force.

The other modules are similar except they have no drive gear and the top of the elongated member has a vertical face for abutment. The printer is always the top member of a stack. If more than one of the other modules are to be stacked, at least the middle ones are small and light enough to be lifted and stacked manually.

The lower modules have one transmission member extending past the general outside surface and an opening in the other side to receive such an extending member, to permit the transmission members of two modules to connect.

BRIEF DESCRIPTION OF THE DRAWING

The details of this invention will be described in connection with the accompanying drawing, in which

FIG. 1' is an enlargement of 15*e* circled part in FIG. 1;

BEST MODE FOR CARRYING OUT THE INVENTION

Figures 1, 1A:
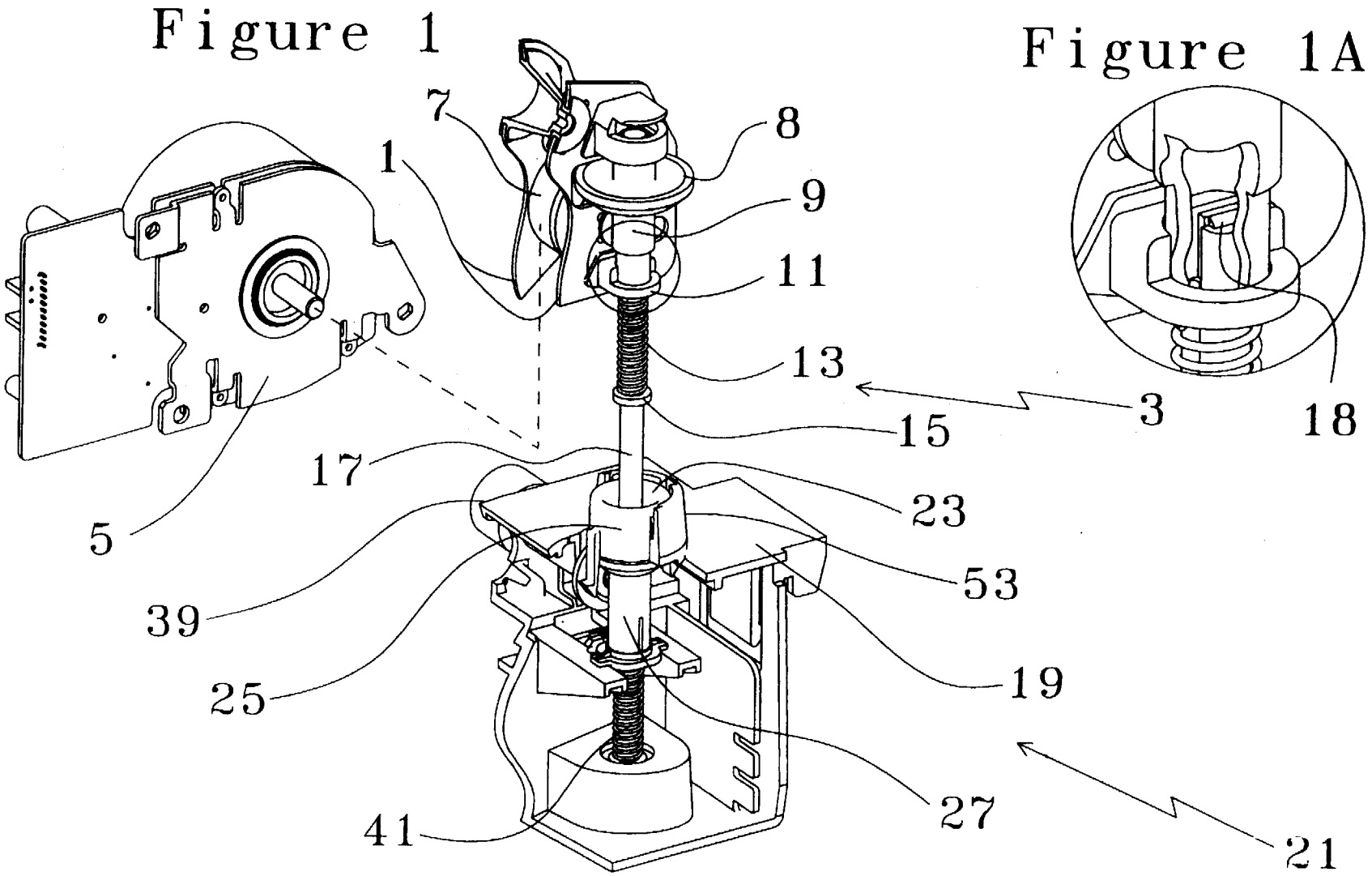
FIG. 1 is an isometric view, partially cut-away of the transmission elements of the printer and a lower module, specifically a paper drawer.

Referring to FIG. 1, the top elements of a printer system are shown for clarity with only frame plates 1. In fact, the top elements are part of the basic printer module 3. A motor 5 is linked through a gear 7 to drive bevel gear 8. A gear box for driving the driven bevel gear of this application is the subject of U.S. patent application Ser. No. 08/684,778, filed Jul. 22, 1996, entitled "Frame With Molded Features" by four joint inventors, three of which are joint inventors of this application.

Gear 8 surrounds and is integral with elongated housing 9, which turns within bushing 11. Compression spring 13 is compressed between the elongated housing 9 and a ledge 15 which encircles shaft 17 to provide downward force on shaft 17.

Figure 2B:
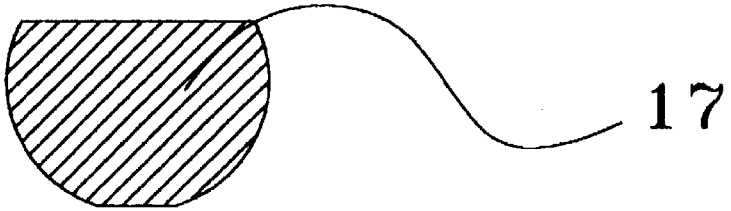
FIGS. 2*a* and 2*b* illustrate the cross section of the shaft and cavity.
Figure 2A:
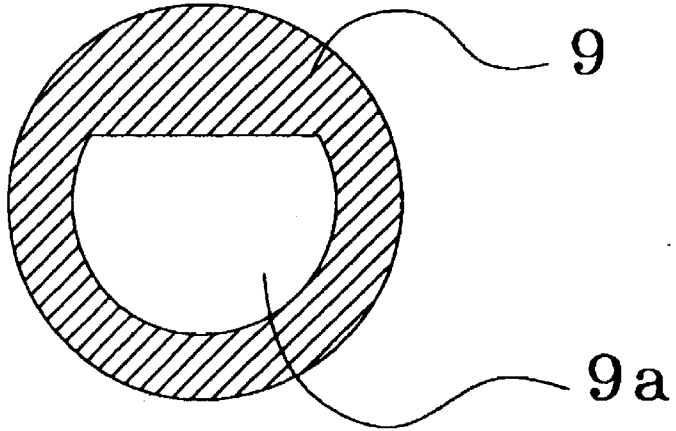

Shaft 17 has an upper cross section as shown in FIG. 2*b* and the lower region of elongated housing 9 has a hole 9*a* of the same cross section as shown in FIG. 2*a*. These cross sections are noncircular, in the form of a letter D. The upper end of shaft 17 is inserted in hole 9*a*. Accordingly, shaft 17 is keyed to the housing 9 so that it must rotate with it. Shaft 17 is free to move longitudinally within housing 9*a* limited amount. As shown by broken-away view in the FIG. 1' enlargement, shaft 17 has a toothed latch 18 which limits the longitudinal movement. (Latch 18 resiliently yields inward to be inserted with pressure from the bottom of hole 9*a*.)

The top frame 19 in the upper surface of the separable paper drawer 21 has a tapered conical guide surface 23 which is integral with and converges toward an internal bushing 25 (see FIG. 1), in which a lower elongated housing 27 is held.

Figure 3:
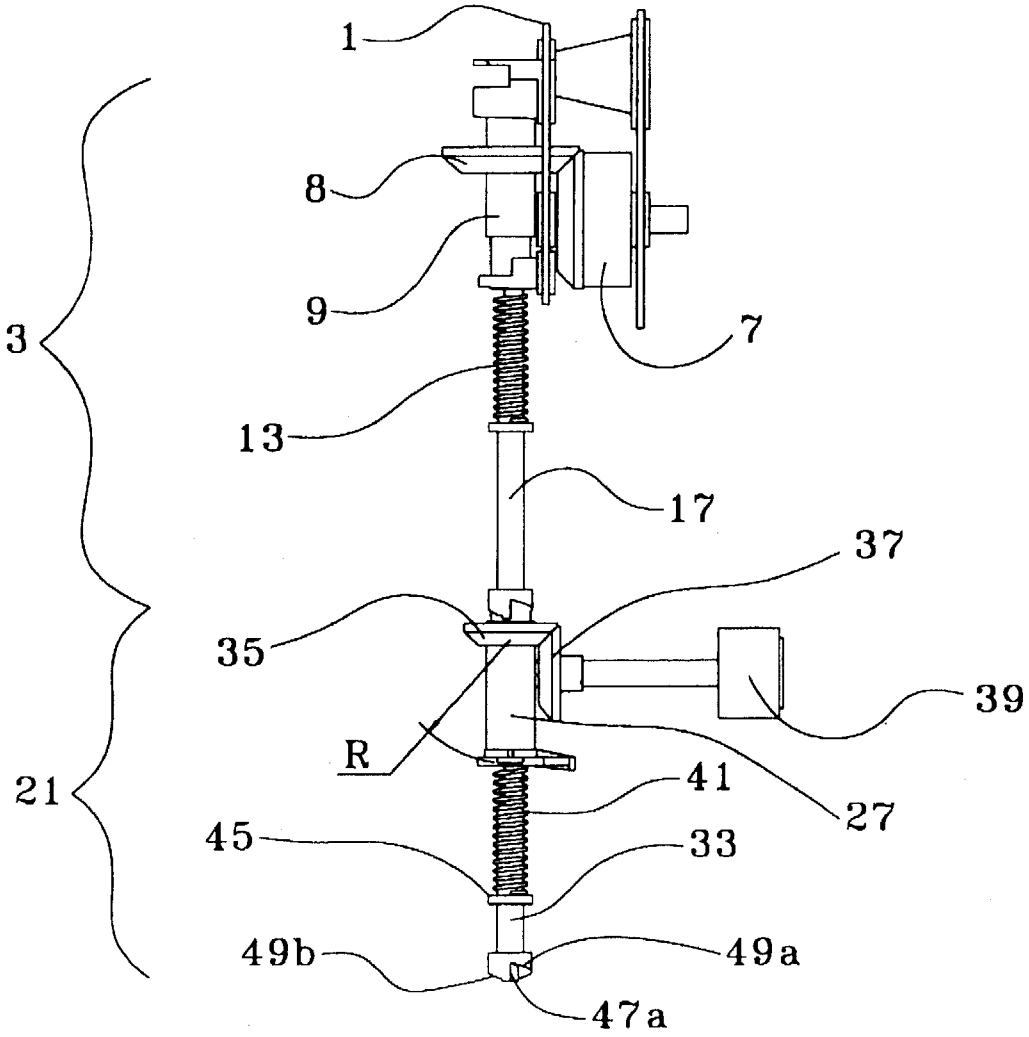
FIG. 3 illustrates the main elements of the transmission train of the printer and one lower module.

Reference is made to FIG. 3 to show a simplified elevation view of main elements of a printer module 3 mounted on a paper drawer 21. Frame 1 supports gear 7 which drives bevel gear 8. Gear 8 is integral with elongated member 9. Member 9 has shaft 17 partially inserted in its internal cavity 9*a* (FIG. 2). Shaft 17 is biased downward by spring 13 and is moved upward if forced in that direction by the lower surface of shaft 17 not finding the lowest surface match with the top of the elongated member 27 of the paper drawer 21.

Figure 4:
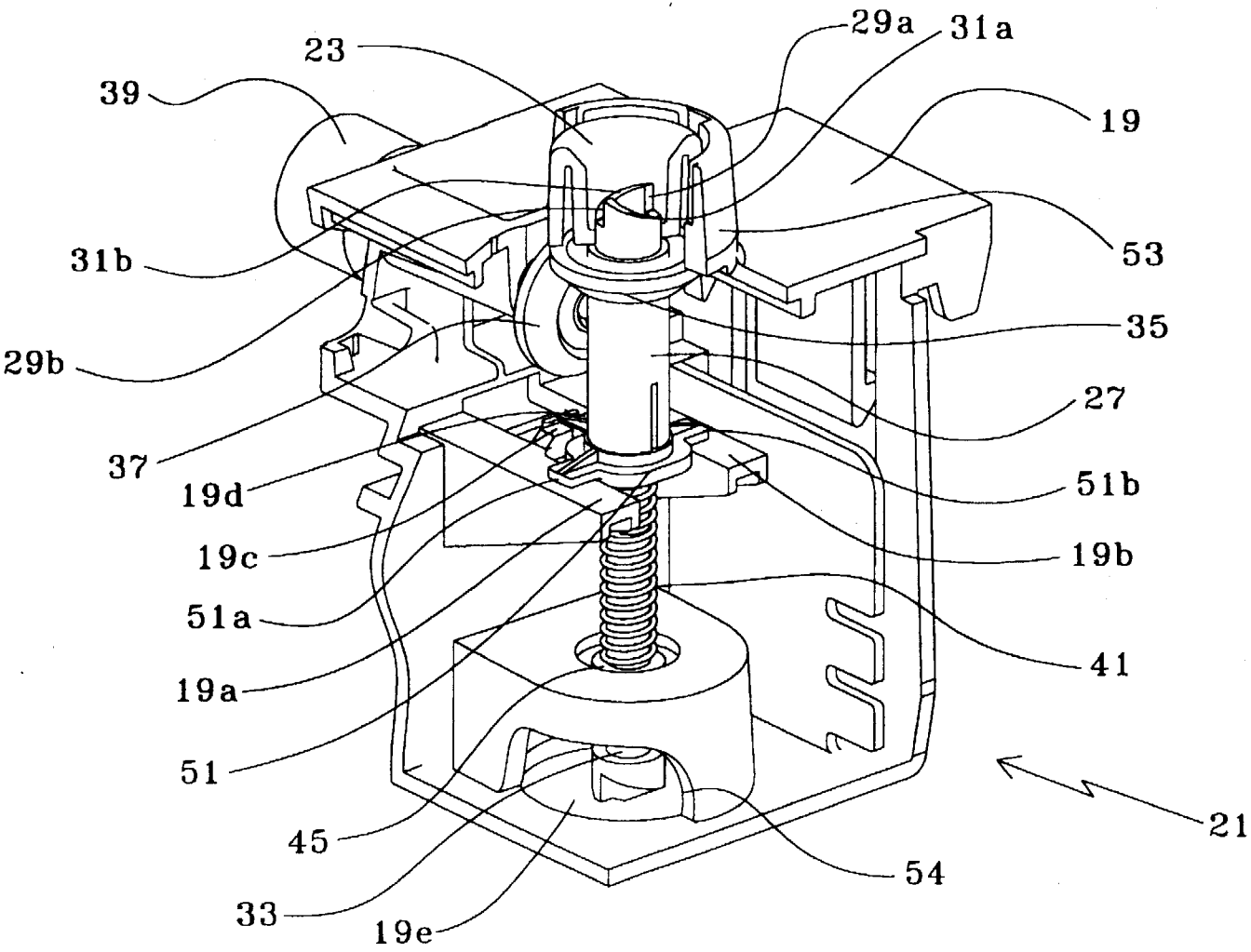
FIG. 4 is an isometric view, partially cut-away with details added of the lower module.

Reference is made to FIG. 4 for a more detailed description of the elements of the paper drawer 21. FIG. 4 illustrates the abutment surfaces at the end of elongated housing 27. These are two vertical surfaces 29*a*, 29*b*, on opposite sides which have ramp surfaces 31*a*, 31*b* leading to them. This configuration is the same at the end of the shaft 17 and the shaft 33 in paper drawer 21 so that as upon rotation, vertical faces 31*a*, 31*b* and their equivalent surfaces on the shafts 17, 33 come into contact for subsequent rotational driving.

Elongated housing 27 has a bevel gear 35 integral with it, which meshes with a bevel gear 37, to drive sheet feed roller 39. Spring 41 surrounds shaft 33 and presses a ledge 45 on shaft 33 and elongated member 27 to permit limited movement of shaft 33 within member 27, all the same as described for member 9, shaft 17 and spring 13. FIG. 3 best illustrates that the bottom end of shaft 33 has the vertical surfaces 47*a* (one shown) and ramps 49*a*, 49*b*.

A thrust bearing 51, has extensions 51*a*, 51*b*, which rest on ledges 19*a*, 19*b* of frame 19. This permits sliding for limited automatic adjustment of the location of shaft 33 when shaft 33 is placed on a lower module for power transmission to that lower module.

Figure 6:
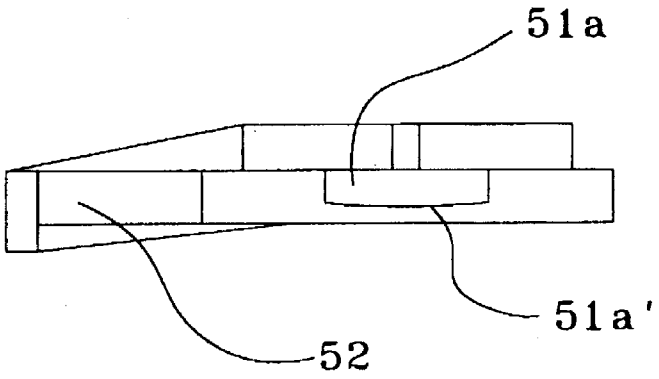
FIG. 6 is a side view of the thrust bearing.
Figure 5:
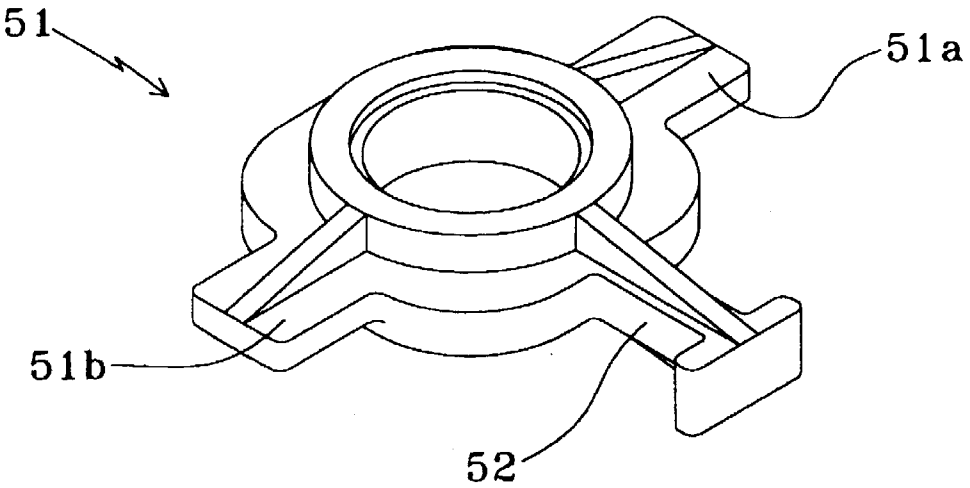
FIG. 5 is an isometric view of the thrust bearing.

Bearing 51 is shown in more detail in FIGS. 5 and 6. It supports housing 27 at a location well spaced from bevel gear 35. Extension 51*a* and 51*b* have curved bottom surfaces 51*a*' (FIG. 6, the bottom surface of 51*b* being identical). Bearing 51 has an integral, T-shaped neck 52, the curvature of the bottom surfaces of 51*a* and 51*b* is at a curvature defined by an are from location of bevel gear 35 directly above the extension 51*a* and 51*b* (illustrated as R in FIG. 3).

This allows bearing 51 to roll on ledges 19*a*, 19*b* and rotate the elongated housing 27 around the center of bevel gear 35. This has minimal effect on the mesh with gear 35, yet allows housing 27 to move enough to take up variations in the next module since the gear 35 is close to the pivot point and therefore moves less than housing 27.

The T-shaped neck 52 fits between posts 19*c*, 19*d* of the frame which allows bearing 51 to move horizontally a limited amount, which prevents bearing 51 from turning. Since the stacked units such as tray 21 may be significantly offset or not perfectly matched, some free movement as provided by bearing 51 is necessary. Since bearing 51 is a separate piece, it can be economically fabricated from wear-resistant material. The primary frame material may be chosen for strength.

Elongated housing 27 and guide surface 23 extend above the general outline of frame 19 and are surrounded by an outer wall 53 (shown with the left side broken away). Similarly, the bottom of frame 19 has opening 19*e* (shown by break away in FIG. 4) surrounded by a inner, curved wall 54. Opening 19*e* will receive outer wall 53, thereby permitting modules having similar structure to be stacked with the shaft 33 of one engaging the elongated housing 27 of the other.

In operation the modules are simply picked up and stacked vertically. The printer 3 is always on top. During a sheet feed operation, motor 5 is simply started and kept running. As shaft 17 turns the ramp surfaces (identical to 49*a*, 49*b*, FIG. 3) move smoothly under pressure from spring 13 on the ramp surfaces 31*a*, 31*b* of elongated member 27 until the abutments surfaces of shaft 17 (identical to 47*a*) meet abutment surfaces 29*a*, 29*b* of elongated member 27 to then transmit rotation from the top module 3 to the lower module 21. Timing and picking of paper are by other mechanisms forming no part of this invention.

Several modules basically the same in power transmission to module 21 may be stacked with power transmitted from the top of printer 3 through each module in the same manner as described. Variations will be apparent and may be anticipated. Patent coverage is sought as provided by law, with particular reference to the accompanying claims.

What is claimed is:

1. Printing system apparatus of a form and weight to permit manual lifting and positioning of said apparatus, comprising for power transmission:

an elongated housing having a longitudinal axis, said housing having a cavity of noncircular cross section along said longitudinal axis, a gear integral with said housing with axis concentric with said longitudinal axis of said housing, a motor to drive said gear, a shaft partially inserted in said cavity and having a cross section where said shaft is inserted in said cavity keying said shaft for rotation with said housing while said shaft being free to move limited amounts longitudinally within said cavity, a resilient member mounted between said shaft and said elongated housing to push said shaft longitudinally away from said housing, and an abutment surface generally parallel to said longitudinal axis on the end of said shaft away from said housing for abutment against an abutment surface of a second printing system apparatus to transmit power form said motor through said shaft to said second printing system apparatus.

2. The apparatus as in claim 1 in which said end of said shaft has a ramp surface leading to said abutment surface.

3. Printing system apparatus comprising for power transmission:

a bushing mounted in said apparatus, an elongated housing having a longitudinal axis mounted in said bushing for rotation, said housing having a cavity of noncircular cross section along said longitudinal axis at a first end and an abutment surface at the opposite end, a tapered guide surface at said opposite end converging around said bushing, a shaft partially inserted in said cavity and having a cross section where said shaft is inserted in said cavity keying said shaft to said housing for rotation with said housing while said shaft being free to move limited amounts longitudinally within said cavity, and a resilient member mounted between said shaft and said elongated housing to push said shaft longitudinally away from said housing.

4. The apparatus as in claim 3 in which said opposite end of said elongated housing has a ramp surface leading to said abutment surface.

5. The apparatus as in claim 3 in which said apparatus is of form and weight to permit manual lining and positioning of said apparatus.

6. The apparatus as in claim 5 in which said face of said opposite end of said elongated housing has a ramp surface leading to said abutment surface.

7. The apparatus as in claim 5 in which the end of said shaft away from said elongated housing has an abutment surface generally parallel to said longitudinal axis for engaging an abutment surface of a power transmission mechanism in a second apparatus on which said apparatus is placed.

8. The apparatus as in claim 3 in which said resilient member is a coil spring encircling said shaft and mounted between said elongated housing and a ledge on said shaft.

9. The apparatus as in claim 3 in which said elongated housing is also mounted in a thrust bearing, with said thrust bearing having extensions resting on frame members of said apparatus, said extensions being in contact with said frame member to slide to permit limited adjustment of the position of said elongated housing.

10. The apparatus as in claim 9 in which said resilient member is a coil spring encircling said shaft and mounted between said elongated housing and a ledge on said shaft.

11. The apparatus as in claim 10 in which said apparatus is of form and weight to permit manual lifting and positioning of said apparatus.

12. The apparatus as in claim 11 in which the end of said shaft away from said housing has an abutment surface generally parallel to said longitudinal axis for engaging an abutment surface of a power transmission mechanism in a second apparatus on which said apparatus is placed.

13. A stacked printing system comprising apparatus of claim 1 mounted on the apparatus of claim 3 with said abutment surface of said shaft of the apparatus of claim 1 positioned to engage said abutment surface of said elongated housing of the apparatus of claim 3 for transmission of power from said motor of the apparatus of claim 1 to the apparatus of claim 3.

14. A stacked printing system comprising apparatus of claim 2 mounted on the apparatus of claim 4 with said abutment surface of said shaft of the apparatus of claim 2 positioned to engage said abutment surface of said elongated housing of the apparatus of claim 4 for transmission of power from said motor of the apparatus of claim 2 to the apparatus of claim 4.

15. A stacked printing system comprising apparatus of claim 14 mounted with said apparatus of claim 4 mounted on a second apparatus of claim 4 with said abutment surface of said shaft of said first apparatus of claim 4 positioned to engage said abutment surface of said elongated housing of said second apparatus of claim 4 for transmission of power from said motor of the apparatus of claim 2 to said first apparatus of claim 4 and from said first apparatus of claim 4 to said second apparatus of claim 4.

16. A stacked printing system comprising apparatus of claim 13 mounted with said apparatus of claim 3 mounted on a second apparatus of claim 3 with said abutment surface of said shaft of said first apparatus of claim 3 positioned to engage said abutment surface of said elongated housing of said second apparatus of claim 3 for transmission of power from said motor of the apparatus of claim 1 to said first apparatus of claim 3 and from said first apparatus of claim 3 to said second apparatus of claim 3.

17. Printing system apparatus comprising for power transmission:

an elongated housing having a longitudinal axis mounted in said apparatus, said housing having a cavity of noncircular cross section along said longitudinal axis at a first end and an abutment surface at the opposite end, said elongated housing extending above the general top surface of said apparatus, and a shaft partially inserted in said cavity and having a cross section where said shaft is inserted in said cavity keying said shaft to said housing for rotation with said housing while said shaft being free to move limited amounts longitudinally within said cavity, said shaft being within the general outline of said apparatus and the general outline of said apparatus having an opening to receive the part of said elongated housing extending above the general top outline of said apparatus so that the shaft on one such apparatus can engage the elongated housing of another such apparatus.

18. The apparatus as in claim 17 in which said opposite end of said elongated housing has a ramp surface leading to said abutment surface.

19. The apparatus as in claim 18 in which said apparatus is of form and weight to permit manual lifting and positioning of said apparatus.

20. The apparatus as in claim 17 in which said apparatus is of form and weight to permit manual lifting and positioning of said apparatus.

21. Printing system apparatus comprising for power transmission:

a frame supporting said printing system apparatus, an elongated housing having a longitudinal axis, said housing having a cavity along said longitudinal axis of said housing, a gear integral with said housing with axis concentric with said longitudinal axis of said housing, a bear supporting said elongated housing at a position spaced from said gear, said bearing having extensions on opposite sides which rest on said frame of said apparatus, said extensions having curved bottoms for rotation of said housing generally around a pivot point located at said gear, said bearing being free for such limited movement, a shaft partially inserted in said cavity, a resilient member mounted between said shaft and said elongated housing to push said shaft longitudinally away from said housing, and an abutment surface on the end of said shaft away from said housing.

* * * * *